US007269376B2

(12) United States Patent
Shoji

(10) Patent No.: US 7,269,376 B2
(45) Date of Patent: Sep. 11, 2007

(54) IMAGE FORMING DEVICE

(75) Inventor: Katsushi Shoji, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 175 days.

(21) Appl. No.: 11/144,552

(22) Filed: Jun. 2, 2005

(65) Prior Publication Data

US 2006/0013612 A1 Jan. 19, 2006

(30) Foreign Application Priority Data

Jul. 14, 2004 (JP) ..... 2004-206667

(51) Int. Cl.
*G03G 21/16* (2006.01)
*G03G 21/18* (2006.01)
*G03G 15/20* (2006.01)

(52) U.S. Cl. ..... 399/111; 399/114; 399/313

(58) Field of Classification Search ..... 399/111, 399/114, 124, 125, 313, 316, 317
See application file for complete search history.

(56) References Cited

U.S. PATENT DOCUMENTS 5,276,489 A * 1/1994 Kikuchi et al. ..... 399/316

FOREIGN PATENT DOCUMENTS

| | | |
|---|---|---|
| JP | 08-087227 | 4/1996 |
| JP | 11-052814 | 2/1999 |
| JP | 2003-121976 | 4/2003 |

* cited by examiner

*Primary Examiner*—Hoang Ngo
(74) *Attorney, Agent, or Firm*—Hogan & Hartson LLP

(57) ABSTRACT

An image forming device includes a process unit having a photoconductive drum that is inserted and removed with respect to a device main body from a front side thereof in an axial direction of the photoconductive drum. The device main body includes a transfer roller that nips printing paper with the photoconductive drum and transfers a toner image on a surface of the photoconductive drum onto the printing paper. A transfer guide supports the transfer roller and is capable of being slanted in a direction in which the transfer roller and the photoconductive drum make contact with one another and separate from one another. An elastic member urges the transfer roller in a direction to make contact with the photoconductive drum. An operation member slants the transfer guide against an urging force of the elastic member by an operation from the front side of the device main body.

18 Claims, 8 Drawing Sheets

PRIOR ART

IMAGE FORMING DEVICE

BACKGROUND OF THE INVENTION

1. Field of the Invention

The present invention relates to an image forming device which is preferably used in a printer, a facsimile machine and a copying machine or the like and forms an image such as a character and a figure on printing paper.

2. Description of Related Art

A printer, a facsimile machine and a copying machine are a known image forming device for printing an image such as a character and a figure onto printing paper. FIG. 8 shows an example of an image forming unit of a conventional image forming device. A charging device 901 impressed with a prescribed bias voltage charges a surface of a photoconductive drum 902. According to image information, a Light Emitting Diode (LED) head 903 selectively exposes the photoconductive drum 902 and an electrostatic latent image is formed on the surface of the photoconductive drum 902. A charged toner 911 is supplied from a developing device 904 to the electrostatic latent image and a toner image is formed. The toner image is transferred onto printing paper 910 by a transfer roller 905 impressed with a prescribed bias voltage. Then, a fuser device 906 applies heat and pressure to the toner image on the printing paper and the toner image is fixed on the printing paper. Meanwhile, after the transfer process, a surface charge of the photoconductive drum 902 is eliminated by a charge eliminating device 907, and a toner remaining on the surface of the photoconductive drum 902 is removed by a cleaning device 908. Then, the photoconductive drum 902 is charged again by the charging device 901.

In the above-described image forming device, the charging device 901, the photoconductive drum 902, the developing device 904, the charge eliminating device 907 and the cleaning device 908 are accommodated in a cartridge as a process unit 900. The process unit 900 is configured to be capable of being inserted and removed with respect to a device main body. Accordingly, when maintenance work is necessary, for example, when the photoconductive drum 902 wears out or when the toner runs out, each of the devices 901, 902, 904, 907 and 908 can be replaced integrally. As a result, the maintenance work can be carried out easily.

Under a state in which the process unit 900 is inserted in the device main body, the photoconductive drum 902 and the transfer roller 905 in the device main body are making contact with one another. Therefore, when removing the process unit 900 from the device main body, the process unit 900 is preferably moved in a radial direction of the photoconductive drum 902, that is, a direction in which the process unit 900 separates from the transfer roller 905. That is, if the process unit 900 is removed upward in FIG. 8, when inserting or removing the process unit 900, the photoconductive drum 902 and the transfer roller 905 are less likely to be rubbed against one another. As a result, the surface of the photoconductive drum 902 is difficult to damage. Since the process unit 900 is removed in such a direction, in a conventional image forming device, an openable and closable cover is provided on an upper surface or a side surface of the image forming device, and by opening the cover, the process unit 900 is inserted or removed.

Conventional Office Automation (OA) equipment, such as the printer, the facsimile machine and the copying machine is preferably compact in consideration of saving space in an office. However, if an image forming device is configured so that the process unit 900 is inserted or removed from a side of the device main body like the above-described conventional image forming device, space for opening and closing the cover is required to be secured at a side of the device main body. Therefore, from aspects of saving space and convenience of work, the image forming device is preferable to be configured so that a user can make access to the process unit 900 from a front side of the image forming device.

In case of removing the process unit 900 from the front side of the device main body, the process unit 900 is moved in an axial direction of the photoconductive drum 902, in other words, to the front side of the page of FIG. 8. Therefore, the transfer roller 905 is required to be separated from the photoconductive drum 902 in advance so that the surface of the photoconductive drum 902 is not damaged.

If the space for separating the transfer roller 905 is secured sufficiently, the image forming device cannot be downsized. Furthermore, from an aspect of the costs, a number of new additional members for separating the transfer roller 905 is required to be minimized as much as possible.

SUMMARY OF THE INVENTION

According to the present invention, without damaging a photoconductive drum, a process unit including the photoconductive drum can be inserted and removed from a front side of a device main body easily and without taking space.

The present invention relates to an image forming device which transfers a toner image on a surface of the photoconductive drum onto printing paper when the photoconductive drum and a transfer roller nip the printing paper. In such an image forming device, the process unit including the photoconductive drum is provided capable of being inserted and removed from the front side of the image forming device in an axial direction of the photoconductive drum. A transfer guide, which supports the transfer roller, is provided capable of being slanted in a direction in which the transfer roller and the photoconductive drum make contact with one another or separate from one another. The transfer roller is urged in a direction to make contact with the photoconductive drum by an elastic member. An operation member is provided for slanting the transfer guide from the front side of the image forming device against an urging force of the elastic member.

According to the present invention, by slanting the transfer guide, the transfer roller and the photoconductive drum are separated from one another. Therefore, the process unit is inserted and removed in the axial direction of the photoconductive drum without the photoconductive drum being damaged. Furthermore, the user can insert and remove the process unit from the front side of the image forming device easily and without taking space.

According to an aspect of the present invention, the transfer guide preferably constitutes a transportation path of the printing paper.

According to the above aspect, the process unit can be inserted and removed from the front side of the image forming device more easily and without taking space.

According to another aspect of the present invention, the transfer guide is preferably opened and closed along with a cover provided on a side surface of the image forming device.

According to the above aspect, for example, the transfer guide is opened and closed along with a jam access cover, which is provided for removing jammed paper. Therefore, the user can make access to the proximity of the photoconductive drum easily and without taking space, and the user can remove the jammed paper easily.

According to another aspect of the present invention, an openable and closable shutter, which covers the surface of the photoconductive drum, is provided on a housing of the process unit. A shutter control member is provided in the device main body. Accompanying the slanting of the transfer guide, under a state in which the transfer roller and the photoconductive drum are making contact with one another, the shutter control member preferably opens the shutter, and under a state in which the transfer roller and the photoconductive drum are separated from one another, the shutter control member preferably closes the shutter.

According to the above aspect, since the photoconductive drum is protected by the shutter, when inserting or removing the process unit, the photoconductive drum is not damaged by being touched mistakenly by the user.

DETAILED DESCRIPTION OF THE INVENTION

In the following, an embodiment of the present invention will be described. Further, the embodiment to be described below represents one example for implementing the present invention. Therefore, there are various technical limitations in the description. However, unless explicitly stated in the following description to limit the present invention, the present invention shall not be limited to the embodiment.

Figure 1:
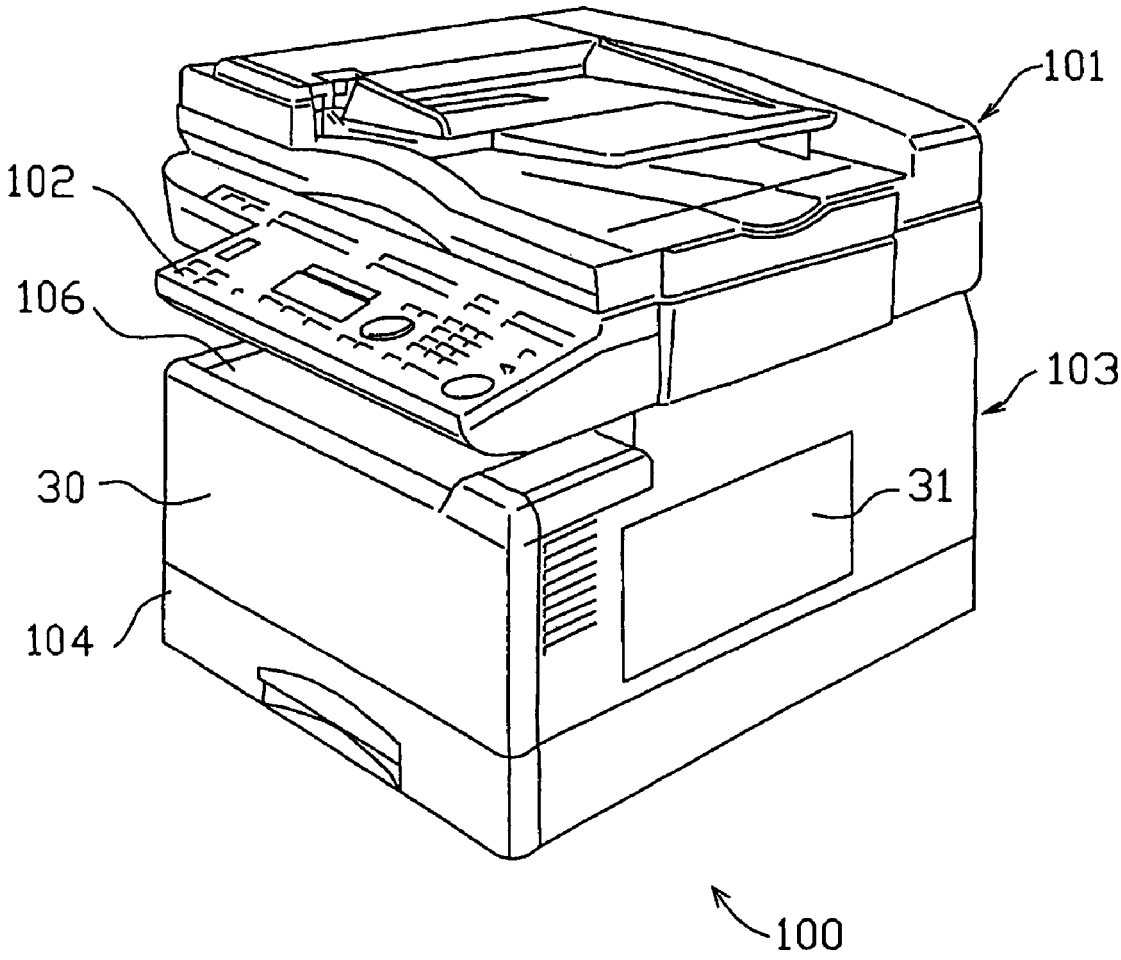
FIG. 1 is a schematic perspective view showing an exterior structure of a copy-and-facsimile Multi Function Peripheral (MFP) according to an embodiment of the present invention.

FIG. 1 is a schematic perspective view showing an exterior of a MFP 100 having a copying function and a facsimile function. The MFP 100 includes an image forming device according to an embodiment of the present invention. As shown in FIG. 1, the MFP 100 includes an image scanning unit 101, an operation panel 102, a device main body 103 and a paper feed cassette 104. The image scanning unit 101 may also function as a flat bed scanner. The operation panel 102 is provided for inputting, for example, a start of scanning or printing of an image. The device main body 103 constitutes a part of the image forming device which forms an image on printing paper. The paper feed cassette 104 sequentially supplies printing papers to the device main body 103. In the MFP 100, a front cover 30 is provided on a front surface of the device main body 103, in other words, on a surface where the operation panel 102 is provided. A jam access cover 31 is provided on a right-side surface of the MFP 100. By opening at least one of the front cover 30 and the jam access cover 31, the user can make access to an inner part of the device main body 103.

Figure 2:
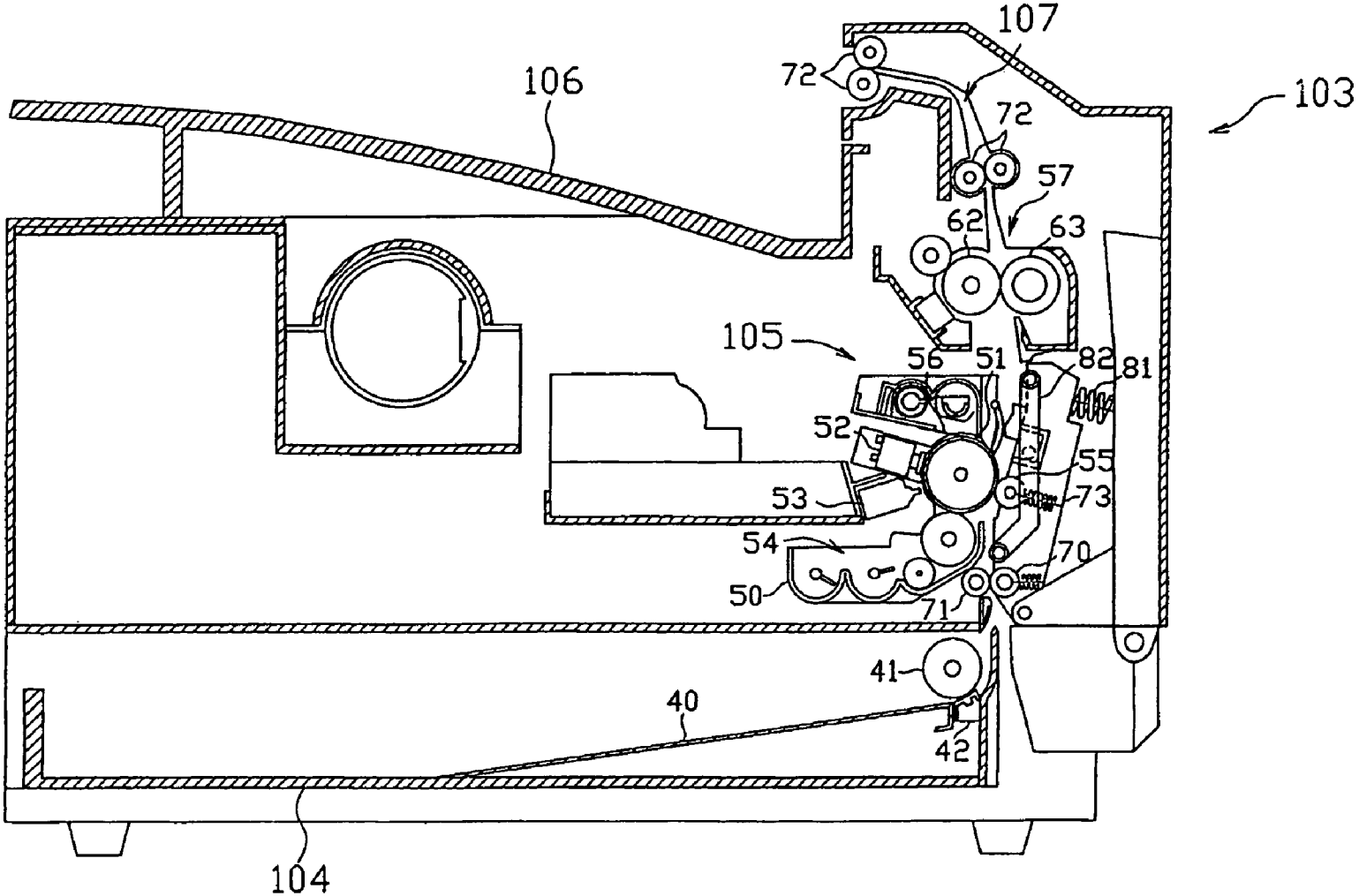
FIG. 2 is a schematic cross-sectional view of a device main body of the copy-and-facsimile MFP.

FIG. 2 is a schematic cross-sectional view showing an inner structure of the device main body 103 and the paper feed cassette 104, which constitute the image forming device, in the MFP 100. As shown in FIG. 2, the paper feed cassette 104 for sequentially feeding printing papers is provided in a bottom part of the image forming device. An image forming unit 105 is disposed above the paper feed cassette 104. A paper discharge tray 106 is disposed above the image forming unit 105. A transportation path 107, which transports printing paper from the paper feed cassette 104 to the paper discharge tray 106, is provided extending upward from one end of the paper feed cassette 104 to be led to the image forming unit 105, provided extending further upward and curved horizontally to be led to the paper discharge tray 106. Further, although not shown in the drawing, the image scanning unit 101 and the operation panel 102 are disposed above the paper discharge tray 106.

The paper feed cassette 104 is a box-shaped cassette which can accommodate printing papers of various sizes. The paper feed cassette 104 is provided in a bottom part of the device main body 103 in a manner capable of being drawn out. A flapper 40, which holds prescribed sized printing paper at a paper feeding position, is disposed inside the paper feed cassette 104. The flapper 40 can be swung within a prescribed range and is urged upward by a spring (not shown). Accordingly, a plural number of sheets of printing papers are held under a stacked state, and one edge of an uppermost sheet is located at the paper feeding position. A paper feed roller 41 and a separating pad 42 are provided at the paper feeding position. The uppermost sheet located at the paper feeding position is contacted against the paper feed roller 41 by the flapper 40.

The paper feed roller 41 is formed of, for example, a silicon roller or an Ethylene-Propylene-Diene Methylene (EPDM) linkage roller fixed on a metal roller shaft. The paper feed roller 41 rotates while making contact with the uppermost sheet, and the printing paper is fed into the transportation path 107. The separating pad 42 is formed of a member, which a coefficient of friction with respect to the printing paper is lower than a coefficient of friction of the paper feed roller 41 with respect to the printing paper and higher than a coefficient of friction of the printing papers. For example, the separating pad 42 is formed of urethane resin. Such a separating pad 42 is disposed below the paper feed roller 41 in a manner capable of moving vertically. The separating pad 42 is urged upward by a spring (not shown). Accordingly, the separating pad 42 makes contact with a roller surface of the paper feed roller 41. The printing papers, which pass through the contact part, are separated and fed one sheet at a time by friction.

Figure 3:
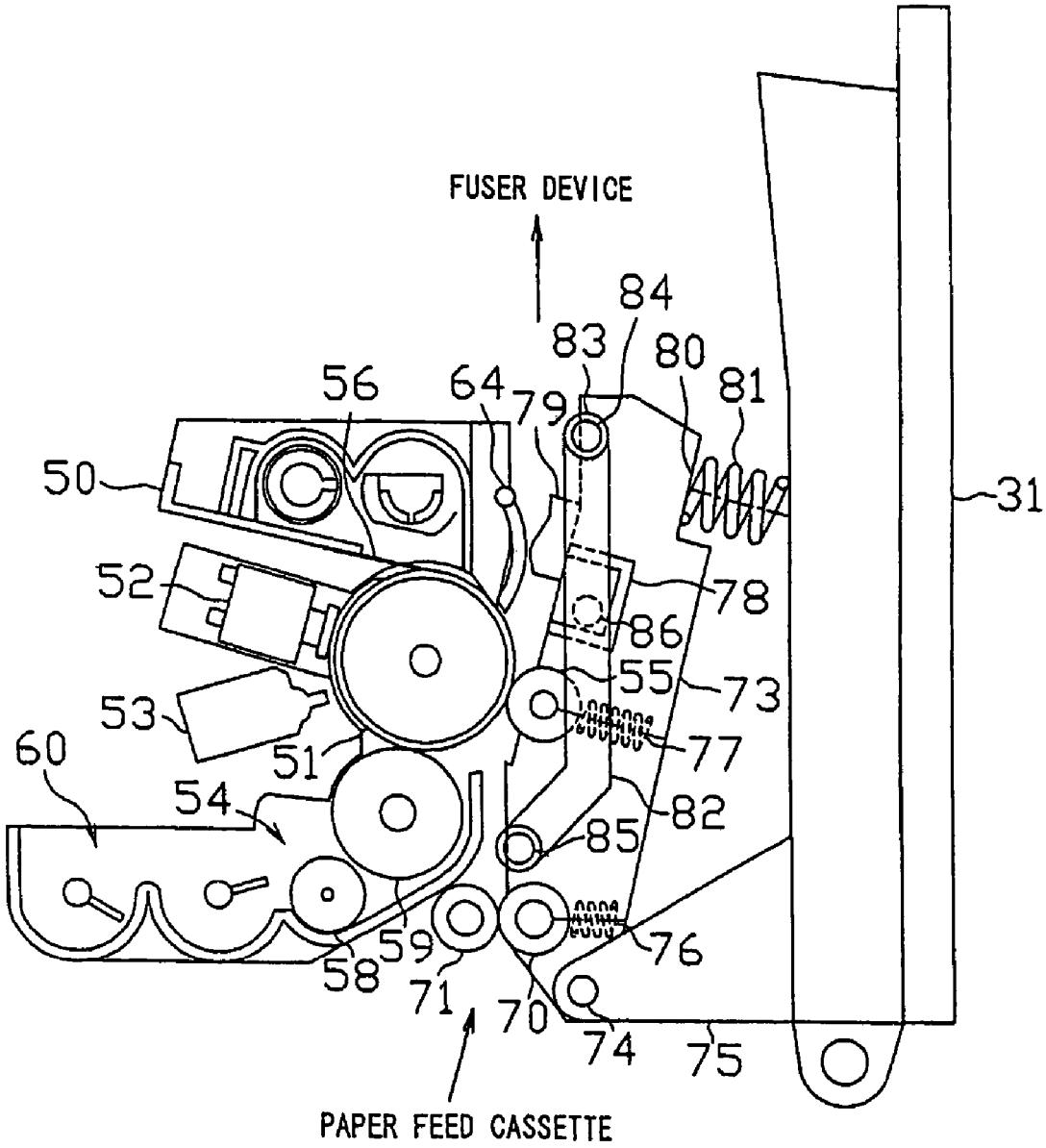
FIG. 3 is an enlarged view showing the proximity of a process cartridge under a state in which a photoconductive drum and a transfer roller are making contact with one another.

As shown in FIG. 2 and FIG. 3, the image forming unit 105 includes a photoconductive drum 51, a charging device 52, an LED head 53, a developing device 54, a transfer roller 55, a cleaning device 56 and a fuser device 57. The charging device 52, the LED head 53, the developing device 54, the transfer roller 55, and the cleaning device 56 are provided around the photoconductive drum 51. The fuser device 57 is provided on the transportation path 107 downstream of the photoconductive drum 51. The photoconductive drum 51, the charging device 52, the developing device 54 and the cleaning device 56 are accommodated in a cartridge and formed integrally as a process unit 50.

The photoconductive drum 51 is a drum in which a photoconductive layer made of an organic photoreceptor is formed around a surface of a cylindrical base. The photoconductive drum 51 is rotated at a prescribed speed by a motor and charged at a constant voltage by the charging device 52. The charging device 52 adopts a noncontact corona charging method. In one embodiment, the charging device 52 is a scorotron charger. Although details are not shown in the drawing, in the charging device 52, a discharge wire is disposed at approximately the center of a casing electrode, which forms a half space, and a grid electrode is disposed to the side of the photoconductive drum 51. When a prescribed voltage is impressed to the discharge wire, a corona discharge is generated, and an ion amount of the corona discharge is controlled by the grid electrode. Further, as the charging device 52, in place of the noncontact-type corona charging device, a contact-type roller charging device or another charging device may be used.

The LED head 53 has an LED array in which LED elements are arranged for a number of printing pixels. A light emitted from the LED array forms an image on the surface of the photoconductive drum 51 by a SELFOC lens array. That is, the LED head 53 is a self-luminous printer head. The LED head 53 selectively exposes the surface of the photoconductive drum 51 in accordance with image information and forms an electrostatic latent image on the surface of the photoconductive drum 51. The LED head 53 exposes the surface of the photoconductive drum 51 charged by the charging device 52. Accordingly, a surface potential of the exposed part is attenuated, and an electrostatic latent image is formed by a potential difference between the exposed part and a non-exposed part. Moreover, an image of an original document scanned by the image scanning unit 101 is transmitted to the LED head 53 as an electric signal. Further, as the exposing device, in place of the LED head 53, a scanning optical system using a semiconductor laser can be adopted.

The developing device 54 includes a supply roller 58, a developing roller 59 and a toner container 60. A bias voltage is impressed to the supply roller 58 and the developing roller 59 from an electric circuit (not shown). According to a difference of the bias voltage impressed to the supply roller 58 and the developing roller 59, the toner of the toner container 60 is supplied via the supply roller 58 to the developing roller 59, and a toner layer is formed on a surface of the developing roller 59. The developing roller 59 on which the toner layer is formed rotates at a position located close to the photoconductive drum 51. At this time, according to the potential difference between the electrostatic latent image of the photoconductive drum 51 and the developing roller 59, the toner on the developing roller 59 moves to the photoconductive drum 51, and a toner image based on the electrostatic latent image is formed on the surface of the photoconductive drum 51. Further, the above-described developing device 54 is one example. Either one of a magnetic toner and a non-magnetic toner may be used and either one of a contact developing method and a noncontact developing method may be used without departing from the scope of the present invention.

The transfer roller 55 is a roller made of an EPDM linkage foam. The transfer roller 55 makes contact with the photoconductive drum 51 across the transportation path 107. A bias voltage is impressed to the transfer roller 55 from an electric circuit (not shown). The printing paper fed from the paper feed cassette 104 via the transportation path 107 is nipped by the photoconductive drum 51 and the transfer roller 55. When the bias voltage is impressed to the transfer roller 55 under this state, the toner image formed on the surface of the photoconductive drum 51 is transferred onto the printing paper.

The cleaning device 56 is a cleaning blade which makes contact with the photoconductive drum 51 after the transfer process. When a constant voltage is impressed to the cleaning device 56 from the electric circuit (not shown), the cleaning device 56 eliminates toner and paper dusts remaining on the surface of the photoconductive drum 51 and erases the electrostatic latent image. Accordingly, the surface of the photoconductive drum 51 is cleaned, and the photoconductive drum 51 can be used continuously. Further, as the cleaning device 56, another contact type method or a noncontact method using a cleaning roller or the like may be adopted. Alternatively, a cleaning-less method not using the cleaning device 56 may be adopted.

The fuser device 57 includes a heat roller 62 and a pressure roller 63. The heat roller 62 and the pressure roller 63 are disposed facing one another across the transportation path 107. The fuser device 57 applies heat and pressure to the toner image on the printing paper transported through the transportation path 107. Accordingly, the toner image is fixed on the printing paper. A surface of the heat roller 62 is maintained at a prescribed temperature by a heater. The pressure roller 63 is pressed against the heat roller 62 under a prescribed pressure. The printing paper on which the toner image is transferred, is nipped by the heat roller 62 and the pressure roller 63. Accordingly, the toner on the printing paper melts and is fixed. By the above-described image forming unit 105, an image of an original document scanned by the image scanning unit 101 is formed on the printing paper.

As shown in FIG. 2, the printing paper is transported from the paper feed cassette 104 along the transportation path 107 to the image forming unit 105. The printing paper on which an image is formed by the image forming unit 105 is discharged onto the paper discharge tray 106. The transportation path 107 is provided extending substantially upward from the paper feed cassette 104 to the image forming unit 105. A pair of the resist rollers 70 and 71 are provided along the transportation path 107 for correcting a transportation state of the printing paper.

A pair of the resist rollers 70 and 71 are provided facing one another across the transportation path 107. A roller surface of the resist rollers 70 and 71 are making contact with one another. Each of the resist rollers 70 and 71 has a roller shaft and a roller fixed on the roller shaft. A rotational force is transmitted from a driving source, such as a motor to the roller shaft and the roller rotates. A leading edge of the printing paper transported from the paper feed cassette 104 towards the image forming unit 105 makes contact with the resist rollers 70 and 71.

A sensor (not shown) is provided upstream of the resist rollers 70 and 71. After a prescribed period of time elapses from a detection of the printing paper by the sensor, the resist rollers 70 and 71 rotate. That is, at a point of time when the leading edge of the printing paper makes contact with the resist rollers 70 and 71, the resist rollers 70 and 71 are at rest. Therefore, the entire range of the leading edge of the printing paper makes contact with the roller surface of the resist rollers 70 and 71 under a state in which a leading edge part is bent.

Accordingly, a skew of the printing paper is corrected. Subsequently, the resist rollers 70 and 71 rotate, and the printing paper is nipped and transported to the image forming unit 105. Transportation rollers 72 are provided appropriately along the transportation path 107 between the image forming unit 105 and the paper discharge tray 106. The printing paper on which an image is formed is transported by the transportation rollers 72 and discharged onto the paper discharge tray 106. Further, the transportation path 107 leading from the paper feed cassette 104 to the paper discharge tray 106 is formed in the shape of letter-C in FIG. 2.

As described above, the photoconductive drum 51, the charging device 52, the developing device 54 and the cleaning device 56 are accommodated, for example, in a synthetic resin cartridge and formed integrally as the process unit 50. The process unit 50 can be removed from the device main body 103 and replaced according to necessity. As shown in FIG. 3, when an image forming process is carried out, the photoconductive drum 51 and the transfer roller 55 are making contact with one another. Therefore, when inserting or removing the process unit 50, the photoconductive drum 51 and the transfer roller 55 are required to be separated from one another to prevent the photoconductive drum 51 from being damaged. In the following, a detailed description will be made of a mechanism for separating the photoconductive drum 51 and the transfer roller 55 from one another.

The process unit 50 is supported on the frame of the device main body 103 and can be held at a prescribed position in the device main body 103. The process unit 50 can be inserted and removed from the front side of the device main body 103 in an axial direction of the photoconductive drum 51. Meanwhile, the transfer roller 55 is supported rotatably on the transfer guide 73, which constitutes a part of the transportation path 107. The transfer guide 73 can be slanted in a direction in which the photoconductive drum 51 and the transfer roller 55 separate from one another. That is, from the state shown in FIG. 3 in which the process unit 50 is inserted in the device main body 103, the process unit 50 can be drawn out to the front side in FIG. 3 and removed. When the process unit 50 is inserted or removed, the transfer guide 73 can be slanted rightward in FIG. 3.

The transfer guide 73 is formed of synthetic resin or a metal plate. As shown in FIG. 3, at a side of the transportation path 107 located opposite to the process unit 50, the transfer guide 73 constitutes a guide surface over a width direction of the transportation path 107. A supporting shaft 74 is provided at a lower end of the transfer guide 73. The supporting shaft 74 is supported by a transportation guide 75, which constitutes the transportation path 107. An upper end side of the transfer guide 73 can be slanted to a side of the device main body 103. The transfer guide 73 rotatably supports the transfer roller 55 and the resist roller 70 so that the transfer roller 55 faces the photoconductive drum 51 and the resist roller 70 faces the other resist roller 71. Springs 76 and 77 are provided on each bearing (not shown). The spring 76 urges the resist roller 70 towards the resist roller 71. The spring 77 urges the transfer roller 55 towards the photoconductive drum 51.

A letter-C shaped pin receiving rib 78, which is opened towards the process unit 50, is provided protruding from a side surface of the transfer guide 73 (the front side of the device main body 103). An operation lever 82 to be described later makes contact with the pin receiving rib 78. On an upper part of the side surface of the transfer guide 73, a shutter pressing part (a shutter control member) 79 is provided protruding towards the process unit 50. Further, in FIG. 3, to facilitate the understanding of the drawing, a tip end part of the shutter pressing part 79 is omitted.

An openable and closable shutter 64 for covering the surface of the photoconductive drum 51 is mounted on a housing of the process unit 50. The shutter 64 is urged by a spring (not shown). Therefore, when the process unit 50 is inserted and removed with respect to the device main body 103, the shutter 64 is closed to cover the photoconductive drum 51. As a result, the surface of the photoconductive drum 51 is not touched mistakenly or damaged. Meanwhile, when the process unit 50 is inserted in the device main body 103 and an image forming process is carried out, the shutter 64 is opened to expose the surface of the photoconductive drum 51. The shutter pressing part 79 is a member for opening the shutter 64.

Figure 4:
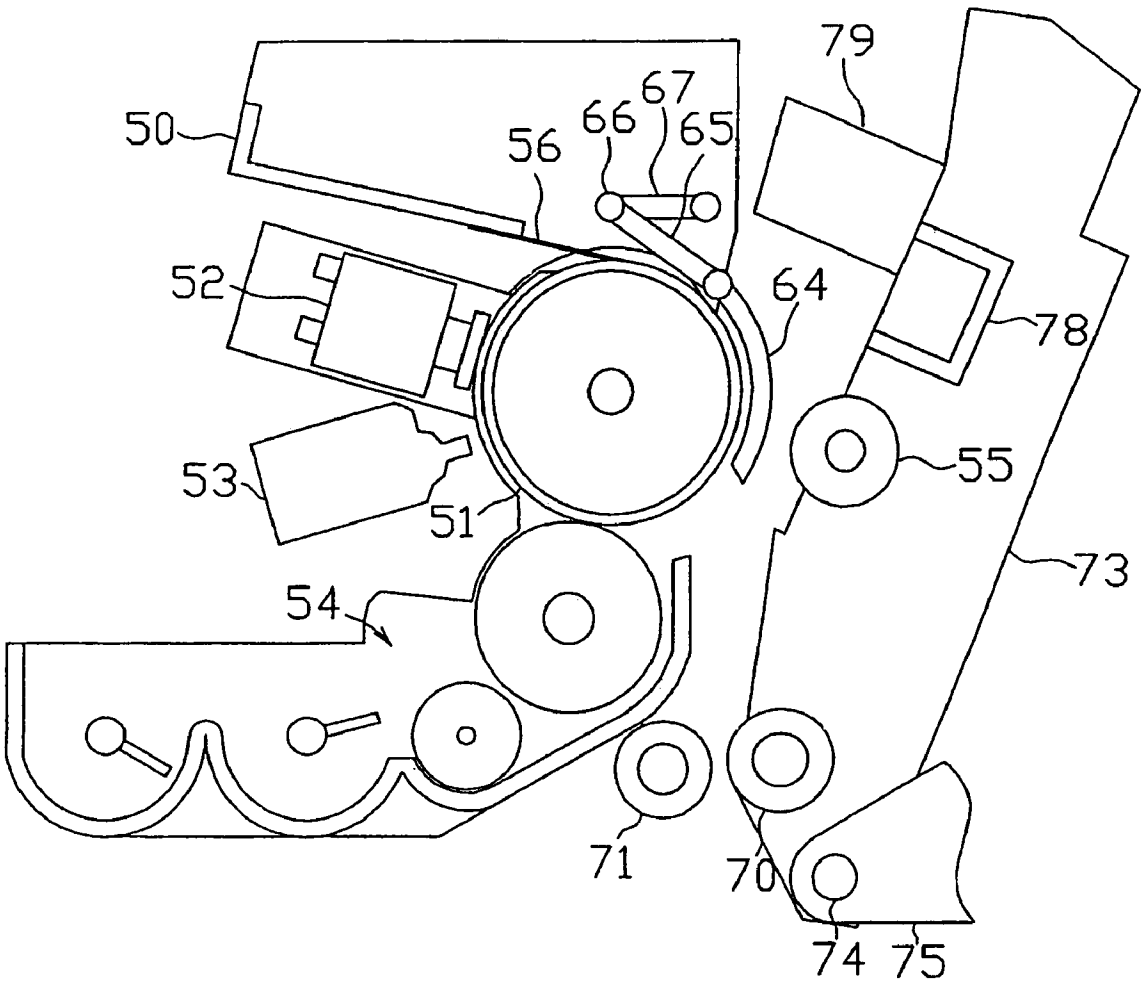
FIG. 4 is an enlarged view for describing a mechanism for opening and closing a shutter of the process cartridge.
Figure 5:
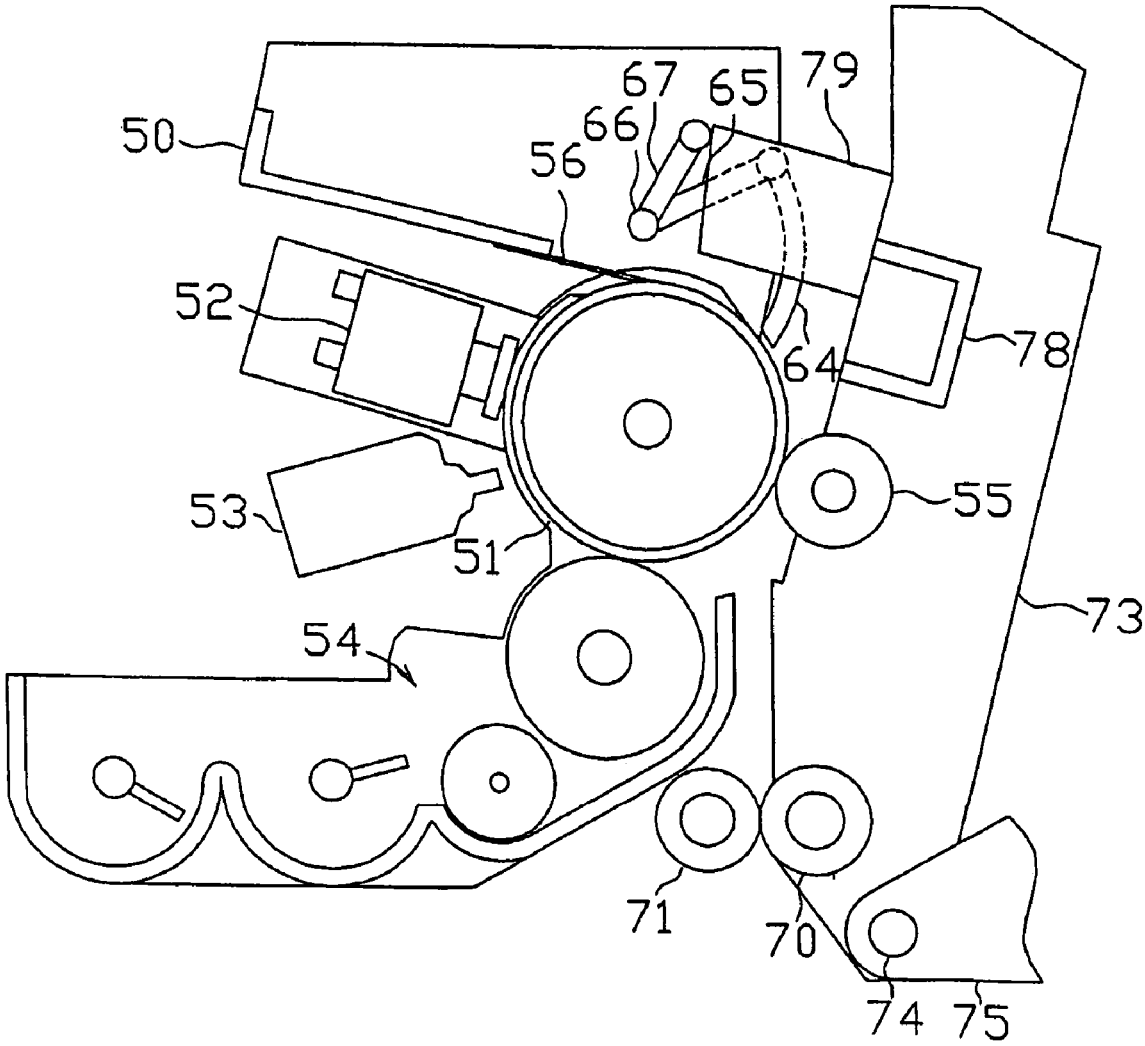
FIG. 5 is an enlarged view for describing a mechanism for opening and closing the shutter of the process cartridge.

FIG. 4 and FIG. 5 show a mechanism for opening and closing the shutter 64. Further, in FIG. 4 and FIG. 5, to facilitate the understanding of the drawings, the operation lever 82 is omitted. As shown in FIG. 4, an upper end of the shutter 64 is supported by a supporting arm 65 in a manner capable of being swung. The supporting arm 65 can be swung around a shaft 66. An operation arm 67 for making contact with the shutter pressing part 79 is mounted on the shaft 66.

As shown in FIG. 4, when the transfer guide 73 is slanted, the photoconductive drum 51 and the transfer roller 55 are separated from one another. Under this state, since the shutter pressing part 79 is located away from the operation arm 67 of the shutter 64, the shutter 64 is closed by the urging force of the spring and covers 19 the surface of the photoconductive drum 51. As shown in FIG. 5, when the transfer guide 73 uprises in a direction in which the photoconductive drum 51 and the transfer roller 55 make contact with one another, the shutter pressing part 79 makes contact with the operation arm 67 of the shutter 64. Accompanying the movement of the transfer guide 73 at this time, the operation arm 67 is pushed upward. Consequently, the shaft 66 rotates and the supporting arm 65 swings around the shaft 66. Accordingly, the shutter 64 is opened against the urging force of the spring and the surface of the photoconductive drum 51 is exposed. As a result, the photoconductive drum 51 and the transfer roller 55 become capable of making contact with one another. Furthermore, when the transfer guide 73 uprises, the photoconductive drum 51 and the transfer roller 55 make contact with one another. Further, in the present embodiment, the shutter pressing part 79 and the operation arm 67 of the shutter 64 are provided at the front side of the device main body 103. However, the shutter pressing part 79 and the operation arm 67 of the shutter 64 can be provided at a rear side of the device main body 103.

As shown in FIG. 3, a spring receiving part 80 is provided at a position located at an upper end part of the transfer guide 73 and at a rear side of the device main body 103. A spring (elastic member) 81 is provided between the spring receiving part 80 and the transportation guide 75. Accordingly, the transfer guide 73 is urged in a direction to press the transfer roller 55 against the photoconductive drum 51. In one aspect, the urging force of the spring 81 is set according to the urging force of the springs 76 and 77, which urge the transfer roller 55 and the resist roller 70, and a distance from the supporting shaft 74 to the springs 76 and 77. That is, the urging force of the springs 76 and 77 works in a direction to slant the transfer guide 73 to the side of the device main body 103. Therefore, to urge the transfer guide 73 by the spring 81 so that the transfer roller 55 makes contact with the photoconductive drum 51, the urging force of the spring 81 is required to be set stronger than the urging force of the springs 76 and 77.

For example, suppose that a distance from the supporting shaft 74 of the transfer guide 73 to an acting point of each of the springs 76, 77 and 81 is respectively L1, L2 and L3, and the urging force of each of the springs 76, 77 and 81 is respectively X, Y and Z. Then, when L1:L2:L3=X:Y:Z, the urging force of the springs 76 and 77 is balanced with the urging force of the spring 81. Therefore, the urging force of the spring 81 can be set stronger than the urging force Z obtained by the above equation. Further, the transfer roller 55 and the resist roller 70 are preferably provided with an extra measurement so that each of the transfer roller 55 and the resist roller 70 can move in a contacting direction according to the thickness of the printing paper. Therefore, the urging force of the spring 81 is also preferable to be set in consideration of the extra measurement. Accordingly, when the transfer guide 73 receives the urging force of the spring 81, the transfer roller 55 makes contact with the photoconductive drum 51 and the resist roller 70 makes contact with the resist roller 71. Under this state, the image forming unit 105 forms an image on the printing paper.

Figure 6:
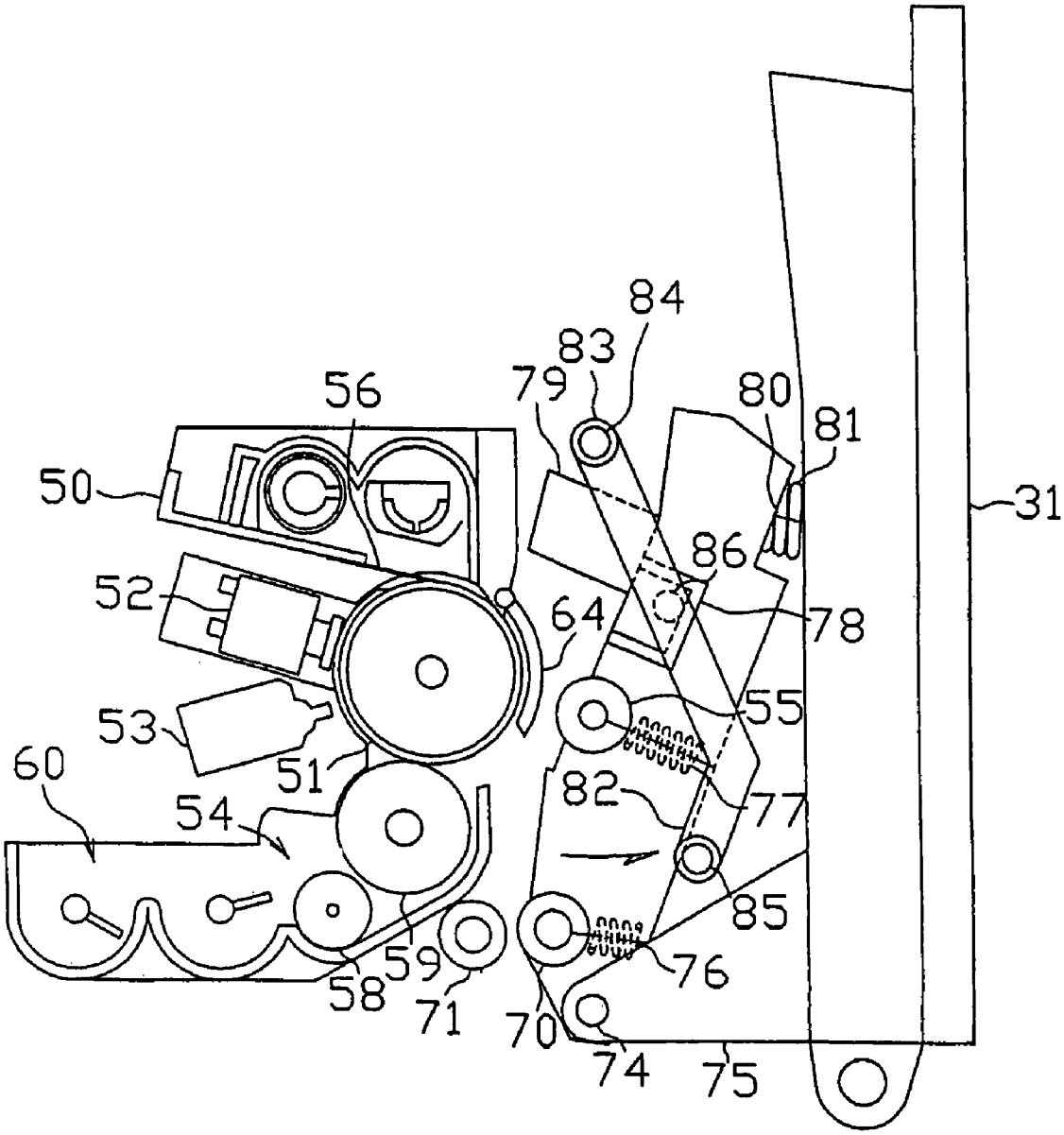
FIG. 6 is an enlarged view showing the proximity of the process cartridge under a state in which the photoconductive drum and the transfer roller are separated from one another.

As shown in FIG. 3, the operation lever (operation member) 82 for slanting the transfer guide 73 is provided at the front side of the transfer guide 73. The operation lever 82 is formed of a steel product or synthetic resin. An upper end part 83 of the operation lever 82 is fit on a shaft 84, which is provided on the device main body 103 or the transportation guide 75, in a manner capable of being swung. An operation handle 85 is fixed on a lower end part of the operation lever 82. At approximately the center part of the operation lever 82, a pin 86 is provided protruding towards the transfer guide 73. The operation lever 82 is located at a position where the user can make access when the front cover 30 (not shown) of the device main body 103 is opened. As shown in FIG. 6, by swinging the operation handle 85 sideward from the front side of the device main body 103, in other words, rightward in FIG. 6, the pin 86 makes contact with the pin receiving rib 78 of the transfer guide 73, and the transfer guide 73 is slanted against the urging force of the spring 81.

As described above, when the transfer guide 73 is slanted to the side of the device main body 103, the transfer roller 55 separates from the photoconductive drum 51. Accompanying this movement, the shutter pressing part 79 also separates from the operation arm 67 of the shutter 64 and the shutter 64 is closed. Accordingly, the process unit 50 is drawn out in the axial direction of the photoconductive drum 51, in other words, towards the front side in FIG. 6, without the photoconductive drum 51 being damaged. Further, to prevent the transfer guide 73 from returning to the standing state from the state in which the transfer guide 73 is slanted to the side of the device main body 103 by the urging force of the spring 81, a lock mechanism may be provided on the operation lever 82. Accordingly, even when the user removes a hand from the operation lever 82, since the transfer guide 73 is maintained under the slanted state, the user can insert or remove the process unit 50 by using both hands, and it is thus convenient.

Figure 7:
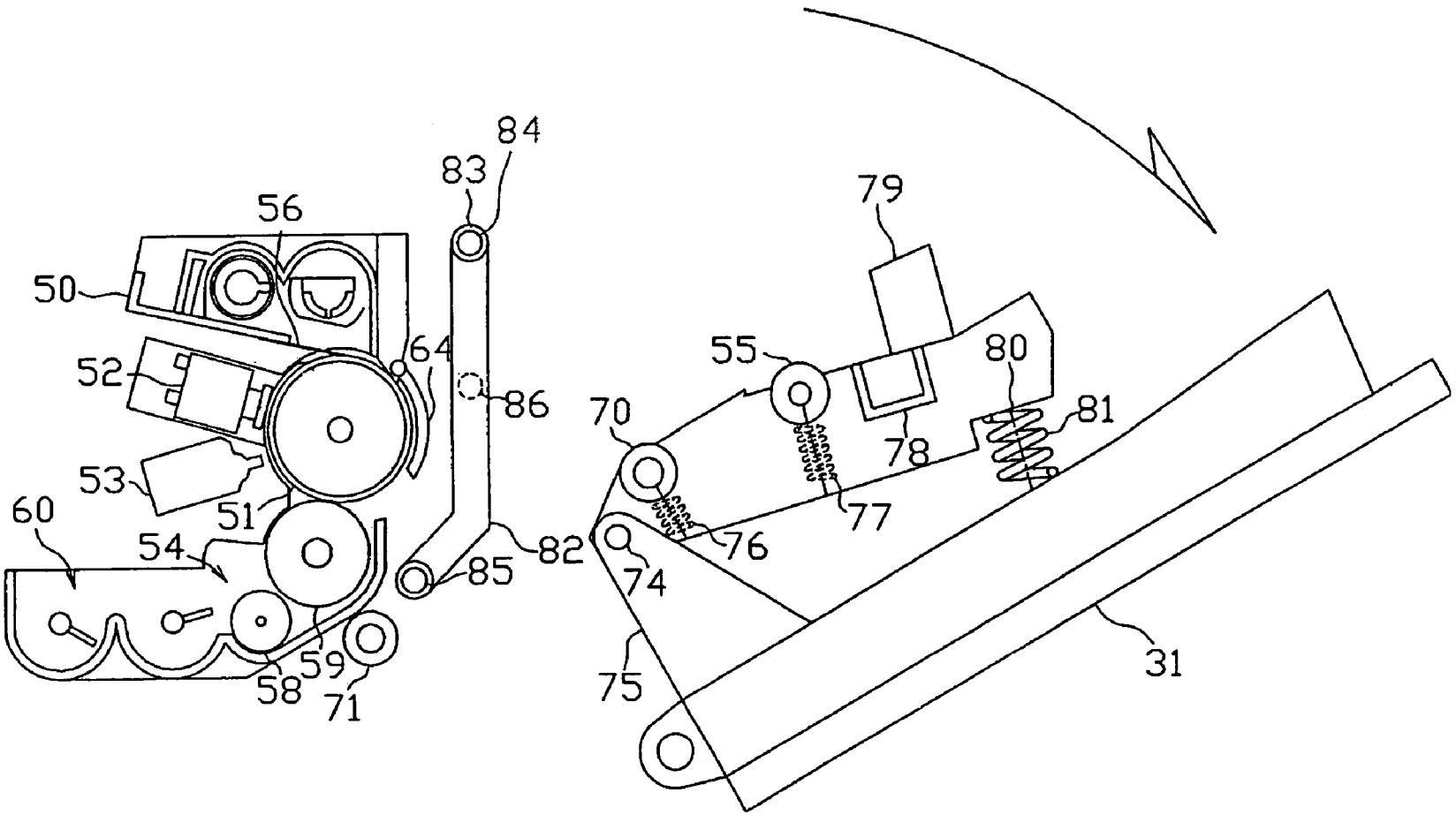
FIG. 7 is an enlarged view showing a structure in proximity of the process cartridge under a state in which a jam access cover is opened.
Figure 8:
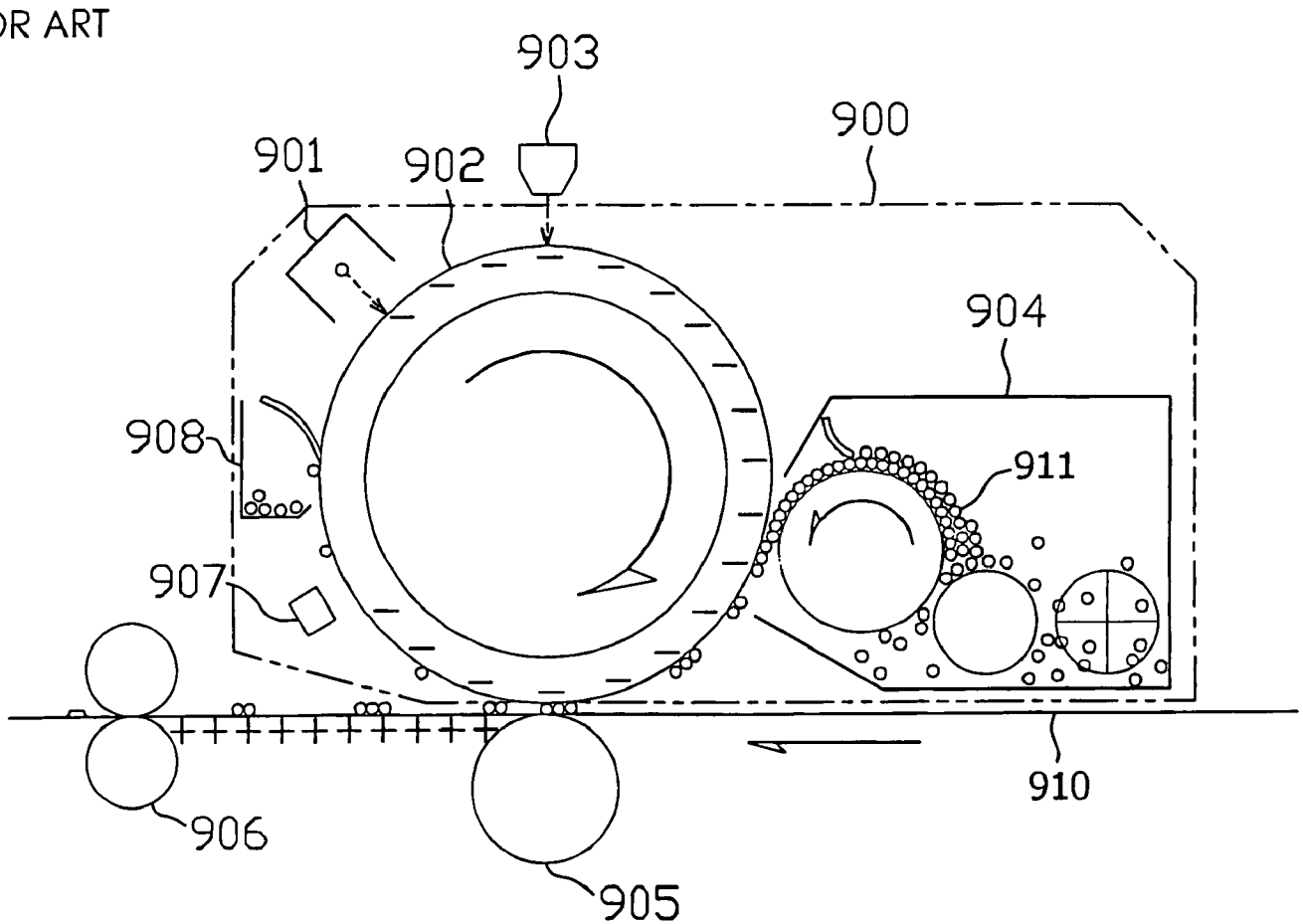
FIG. 8 shows an example of a conventional image forming device.

The transportation guide 75 supporting the transfer guide 73 is supported by the jam access cover 31. As shown in FIG. 7, when the jam access cover 31 is opened, the transportation guide 75 and the transfer guide 73 are also opened along with the jam access cover 31. Therefore, the user can remove paper jammed in proximity of the image forming unit 105 from a side of the device main body 103. As described above, the pin receiving rib 78 of the transfer guide 73, which makes contact with the pin 86 of the operation lever 82, is formed in the shape of letter-C opening towards the process unit 50. Therefore, when the transfer guide 73 is opened along with the jam access cover 31, the pin receiving rib 78 does not interfere with the pin 86. When the transfer guide 73 is opened, the shutter pressing part 79 also separates from the operation arm 67 of the shutter 64, and the shutter 64 is closed. Therefore, when removing the jammed paper, the surface of the photoconductive drum 51 is prevented from being touched mistakenly by the user. Further, instead of being supported by the transportation guide 75, the transfer guide 73 may be supported by the frame of the device main body 103. In such a case, the frame may be opened along with the jam access cover 31.

As described above, according to the MFP 100 of the present embodiment, under a state in which the transfer guide 73 is slanted by the operation lever 82 and the transfer roller 55 is located away from the photoconductive drum 51, the process unit 50 is inserted and removed in the axial direction of the photoconductive drum 51. Therefore, the process unit 50 can be easily inserted and removed from the front side of the device main body 103 without the photoconductive drum 51 being damaged and without requiring space.

Further, in the present embodiment, a description has been made of an embodiment in which the image forming device is the MFP 100. However, the image forming device is not limited to the MFP 100. For example, the embodiment can be changed to a single function device having a copying function, a facsimile function or a printer function, without departing from the scope of the present invention.

What is claimed is:

1. An image forming device comprising:

a device main body;

a process unit having a photoconductive drum, the process unit is inserted into and removed from the device main body from a front side of the device main body in an axial direction of the photoconductive drum, the process unit further comprising a housing and a shutter mounted on the housing that is openable and closable to cover a surface of the photoconductive drum;

a transfer roller that nips printing paper with the photoconductive drum and transfers a toner image on a surface of the photoconductive drum onto the printing paper;

a transfer guide that supports the transfer roller and is capable of slanting in a direction in which the transfer roller and the photoconductive drum make contact with one another and separate from one another;

an elastic member that urges the transfer roller in a direction to make contact with the photoconductive drum; and an operation member that slants the transfer guide against an urging force of the elastic member by an operation from the front side of the device main body, wherein the device main body further comprises a shutter pressing member, which moves in response to the slanting of the transfer guide, opens the shutter under a state in which the transfer roller and the photoconductive drum are making contact with one another, and closes the shutter under a state in which the transfer roller and the photoconductive drum are located away from one another.

2. The image forming device of claim 1, wherein the transfer guide has a guide surface of a transportation path where the printing paper is transported.

3. The image forming device of claim 1, wherein an upper end side of the transfer guide can be slanted to a side of the device main body.

4. The image forming device of claim 1, wherein the device main body comprises:

a pair of resist rollers, wherein one of the resist rollers is supported by the transfer guide and the pair of the resist rollers correct a transportation state of the printing paper, and a second elastic member that urges the one of the resist rollers towards another one of the resist rollers.

5. The image forming device of claim 1, wherein an upper end part of the operation member is fit on a shaft, which is provided on the device main body, in a manner capable of being swung.

6. The image forming device of claim 5, wherein the operation member includes a pin that protrudes towards the transfer guide, wherein the transfer guide includes a rib that protrudes from a side of the transfer guide, and, by swinging the operation member, the pin makes contact with the rib and the transfer guide is slanted against the urging force of the elastic member.

7. The image forming device of claim 1, further comprising a lock mechanism provided on the operation member and prevents a movement of the transfer guide from a slanted state to a standing state by the urging force of the elastic member.

8. The image forming device of claim 1, wherein the transfer guide can be opened and closed along with a cover provided on a side surface of the device main body.

9. The image forming device of claim 1, wherein the transfer guide is formed of synthetic resin or a metal plate.

10. An image forming device, comprising:

a device main body;

means for processing, wherein the means for processing includes a photoconductive drum and is inserted into and removed from the device main body from a front side of the device main body in an axial direction of the photoconductive drum, the means for processing further comprising a housing and a means for shutting mounted on the housing that is openable and closable to cover a surface of the photoconductive drum;

means for transferring a toner image on a surface of the photoconductive drum onto printing paper by nipping the printing paper with the photoconductive drum;

means for guiding, which supports the means for transferring and is capable of slanting in a direction in which the means for transferring and the photoconductive drum make contact with one another and separate from one another;

means for urging the means for transferring in a direction to make contact with the photoconductive drum; and means for operating to slant the means for guiding against an urging force of the means for urging by an operation from the front side of the device main body, wherein the device main body further comprises means for pressing to open the means for shutting under a state in which the means for transferring and the photoconductive drum are making contact with one another and to close the means for shutting under a state in which the means for transferring and the photoconductive drum are located away from one another, by moving in response to the slanting of the means for guiding.

11. The image forming device of claim 10, wherein the means for guiding has a guide surface of a transportation path where the printing paper is transported.

12. The image forming device of claim 10, wherein an upper end side of the means for guiding can be slanted to a side of the device main body.

13. The image forming device of claim 10, wherein the device main body comprises:

means for resisting to correct a transportation state of the printing paper, wherein the means for resisting includes a pair of resist rollers and one of the resist rollers is supported by the means for guiding, and a second means for urging the one of the resist rollers towards another one of the resist rollers.

14. The image forming device of claim 10, wherein an upper end part of the means for operating is fit on a shaft, which is provided on the device main body, in a manner capable of being swung.

15. The image forming device of claim 14, wherein the means for operating has means for catching provided protruding towards the means for guiding, the means for guiding has means for engaging provided protruding from a side of the means for guiding, and by swinging the means for operating, the means for catching makes contact with the means for engaging and the means for guiding is slanted against the urging force of the means for urging.

16. The image forming device of claim 10, further comprising means for locking to prevent a movement of the means for guiding from a slanted state to a standing state by the urging force of the means for urging, wherein the means for locking is provided on the means for operating.

17. The image forming device of claim 10, wherein the means for guiding can be opened and closed along with means for covering provided on a side surface of the device main body.

18. The image forming device of claim 10, wherein the means for guiding is formed of synthetic resin or a metal plate.

* * * * *